United States Patent [19]

Moench

[11] Patent Number: 4,662,024

[45] Date of Patent: May 5, 1987

[54] CENTER-GRIP PAD HOLDER FOR FLOOR MAINTENANCE MACHINE

[75] Inventor: Hans Moench, New York, N.Y.

[73] Assignee: Oceanlense, Limited, London, England

[21] Appl. No.: 771,652

[22] Filed: Sep. 3, 1985

[51] Int. Cl.[4] ..... A47L 11/14

[52] U.S. Cl. ..... 15/230.19; 15/98; 15/242; 51/378; 403/348

[58] Field of Search ..... 15/49 R, 50 R, 98, 230, 15/230.19, 246; 403/348, 349; 51/378, 379

[56] References Cited

U.S. PATENT DOCUMENTS

| | | | |
|---|---|---|---|
| 3,011,190 | 12/1961 | Wilke | 15/49 |
| 3,397,419 | 8/1968 | Okun | 15/49 |
| 3,428,994 | 2/1969 | Collier | 15/49 |
| 3,600,735 | 8/1971 | Jerabek | 15/49 |
| 4,095,303 | 6/1978 | Armstrong et al. | 15/1.5 |
| 4,186,459 | 2/1980 | Wolff | 15/380 |
| 4,391,548 | 7/1983 | Mallah | 403/368 |
| 4,409,702 | 10/1983 | Brown | 15/180 |

*Primary Examiner*—Edward L. Roberts

*Attorney, Agent, or Firm*—Bernard, Rothwell & Brown

[57] ABSTRACT

A pad holder adapted for use with a coupling device which is operably connected to a rotatable drive shaft of a floor maintenance machine includes first and second pad holder members rotatably and detachably joined in coaxial relationship by lugs and cam-like ramps. An annular floor cleaning or polishing pad is held between the pad holder members and gripped for rotation by the drive shaft. Pull tabs are provided for moving the lugs away from engagement with the ramps to quickly disassemble the pad holder.

9 Claims, 8 Drawing Figures

CENTER-GRIP PAD HOLDER FOR FLOOR MAINTENANCE MACHINE

BACKGROUND OF THE INVENTION

1. Field of the Invention

The present invention relates to floor maintenance machines and more particularly relates to a new improved construction of a pad-holding device for units used with floor maintenance machines, such as for buffing, cleaning, polishing and like maintenance-type operations.

2. Description of the Background Art

Floor maintenance machines commonly employ a rotating annular pad for floor buffing, cleaning and polishing. With such machines, the weight of the apparatus generally rests on the pad, the pad being driven by a vertically oriented rotating drive shaft.

Coupling devices for connecting polishing pads to floor maintenance machines commonly include a circular flange on the vertical motor-driven shaft of the machine, the flange having a coaxial projection extending below the flange and being provided with radial projecting lugs spaced below the flange. A second part of the coupling typically includes an annular plate member for receiving the coaxial projection so as to move into engagement with the flange. Extending radially outwardly from the central opening of the plate member are recesses which permit lugs to pass through the plate member so that when the plate member is turned relative to the flange, the lugs move behind a rear face of the plate member to thereby prevent axial movement of the plate member relative to the flange. To limit the turning of the plate member relative to the flange, the plate member usually has solid ramps cast on the rear face, so that the lugs slide up the ramps until the lugs jam tight against the ramps as the annular plate is brought into tight engagement with the flange. Alternatively, the plate member is provided with downwardly projecting stops and pressure springs to limit turning of the plate member relative to the flange. The annular plate member forming the second part of the coupling is generally fixedly connected to the rotating pad member, e.g., by a plurality of screws. Typical coupling devices are described in U.S. Pat. Nos. 3,600,735 and 4,391,548.

When the annular plate member of a coupling device is fixedly attached to a pad member as by a plurality of screws, replacement of the pad requires time-consuming removal of the screws or the necessity of having on hand additional pad members to which have previously been attached the annular plate members of the coupling device.

There remains a need in the art for a device allowing quick interchangeability of pads without decoupling a coupling device.

SUMMARY OF THE INVENTION

In accordance with the present invention, a pad holder adapted for use with a coupling device operably connected to a rotatable drive shaft of a floor maintenance machine includes first and second pad holder members to be joined in coaxial relationship. The first pad holder member includes a first generally cylindrical member having inner and outer surfaces, the outer surface being sized to complementarily mate with and fit within a central aperture of an annular floor cleaning or polishing pad. The inner surface of the first cylindrical member includes at least two arcuate cam-like ramps generally symmetrically disposed opposite each other and circumferentially spaced about the inner surface of the first cylindrical member. The first pad holder member further includes means adapted for supporting a top surface of the annular floor cleaning or polishing pad and for securing the first pad holder member to the coupling device for rotation of the pad holder concurrently with the drive shaft. The second pad holder member includes a second generally cylindrical member having an outer surface sized to complementarily fit within and mate with the inner surface of the first cylindrical member. The second pad holder member further includes at least two lugs adapted to engage the arcuate cam-like ramps of the first cylindrical member for detachably connecting the second cylindrical member to the first cylindrical member by rotation of the second cylindrical member relative to the first cylindrical member. The lugs are connected to the second cylindrical member and extend outwardly from the outer surface of the second cylindrical member. The lugs are generally symmetrically disposed opposite each other and circumferentially spaced about the outer surface of the second cylindrical member. The second pad holder member further includes means for disengaging the lugs from the cam-like ramps by moving the lugs inwardly and away from a position adjacent the inner surface of the first cylindrical member. The second pad holder member further includes means adapted for rotation of the second cylindrical member relative to the first cylindrical member to engage and disengage the lugs with the ramps, and for supporting and holding an annular floor cleaning or polishing pad of a predetermined thickness against the pad top surface-supporting means.

DETAILED DESCRIPTION OF THE PREFERRED EMBODIMENTS

Figure 1:
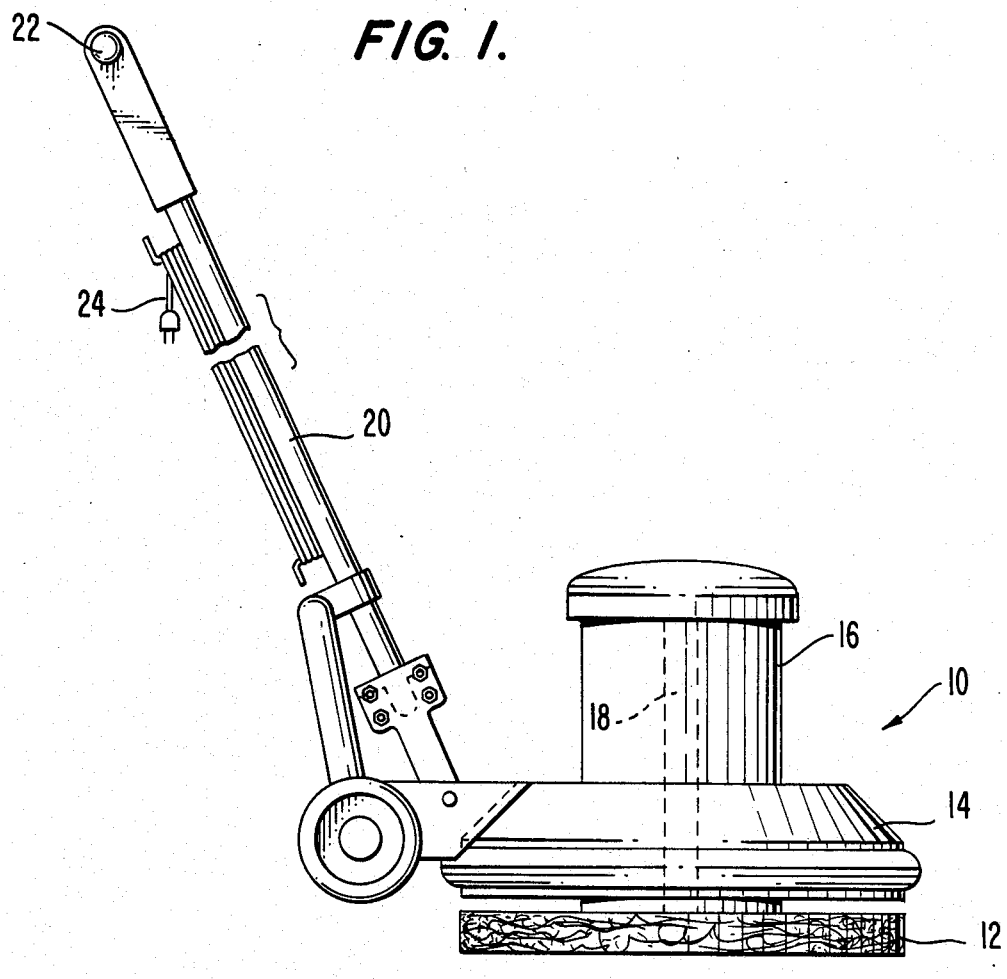
FIG. 1 is an elevational view of a typical floor maintenance machine which can be used with the present invention.

The present invention will be described with reference to a floor maintenance machine 10 of the type which detachably mounts a rotating, generally compressible, floor cleaning or polishing element 12. See FIG. 1. Such floor maintenance machines comprise a body 14 having a driving motor 16 mounted thereon, the motor 16 driving a drive shaft 18 to which the floor cleaning or polishing pad 12 is operably connected for rotation of the pad. The machine 10 is moved by means of a handle 20 having a hand grip 22. The motor 16 is electrically driven and may be connected to an electrical outlet by means of cord 24.

Figure 2A:
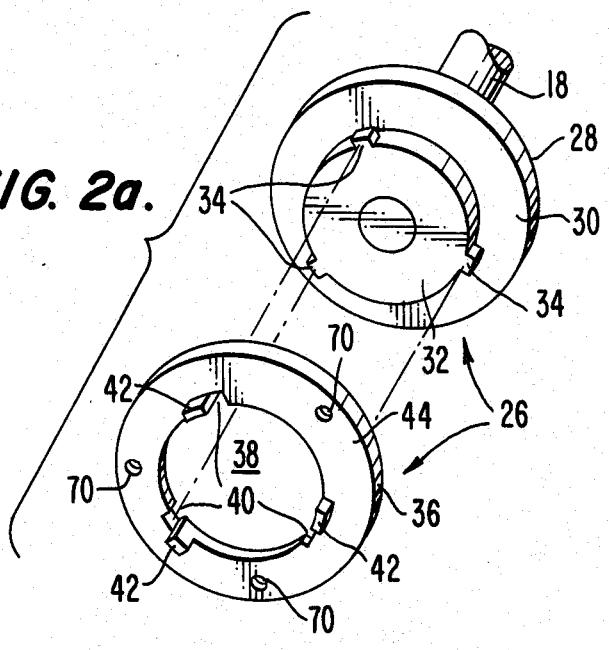
FIG. 2*a* is a perspective view of interconnectable members forming a coupling device for the drive shaft of a floor maintenance machine as shown in FIG. 1 with one coupler removed from the other, to which a pad holder according to the invention can be operably connected.

The drive shaft 18 is operably connected to a cleaning element such as pad 12 by means, which may include a coupling device 26 such as is shown in FIG. 2*a*.

Coupling device 26 includes a circular flange 28 which is fixed relative to the shaft 18 in coaxial relation. The flange 28 presents a horizontally disposed, flat annular bottom surface 30. Coaxially disposed within the annular bottom surface 30 is a projection or hub 32 of circular cross-section, and formed integrally with the hub 32 and extending radially therefrom are lugs 34. The lugs 34 are equally spaced about the circumference of the hub 32 and are axially spaced from the annular bottom surface 30. The shaft 18, flange 28, hub 32 and lugs 34 may be cast as an integral unit and form one member of the coupling device 26.

The other member of the coupling device 26 includes a flat annular plate element or member 36. The annular plate member 36 defines a forward or top surface which may have substantially the same dimensions as the annular bottom surface 30 of circular flange 28. The annular plate member 36 has a central opening 38 of a size to closely receive the hub 32, and the thickness of the annular plate member is slightly less than the axial spacing between the lugs 34 and the bottom annular surface 30 defined by the circular flange.

Extending radially from the central opening 38 are a plurality of circumferentially spaced recesses 40 which are equal in number and spacing to the lugs 34 and which are shaped to permit passage of the lugs when the hub 32 is received in the central opening 38. Associated with each recess and spaced a distance around the periphery is an abutment means or stop 42 in the form of a projection extending axially from the bottom face 44 of annular plate member 36. Annular plate member 36 is operably connected to flange 28 and shaft 18 by orienting the annular plate member to permit the lugs 34 to pass through the recesses 40 as the hub 32 is received in the central opening 38. The annular plate member then is rotated until the lugs 34 engage stops 42.

Figure 2B:
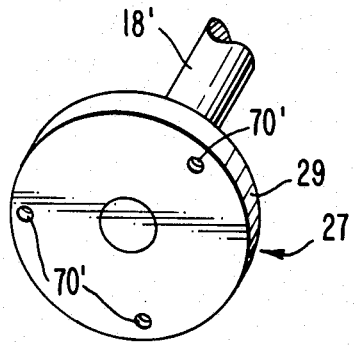
FIG. 2*b* is a perspective view of another type of coupling device for the drive shaft of a floor maintenance machine as shown in FIG. 1, to which a pad holder according to the invention can be operably connected.
Figure 3:
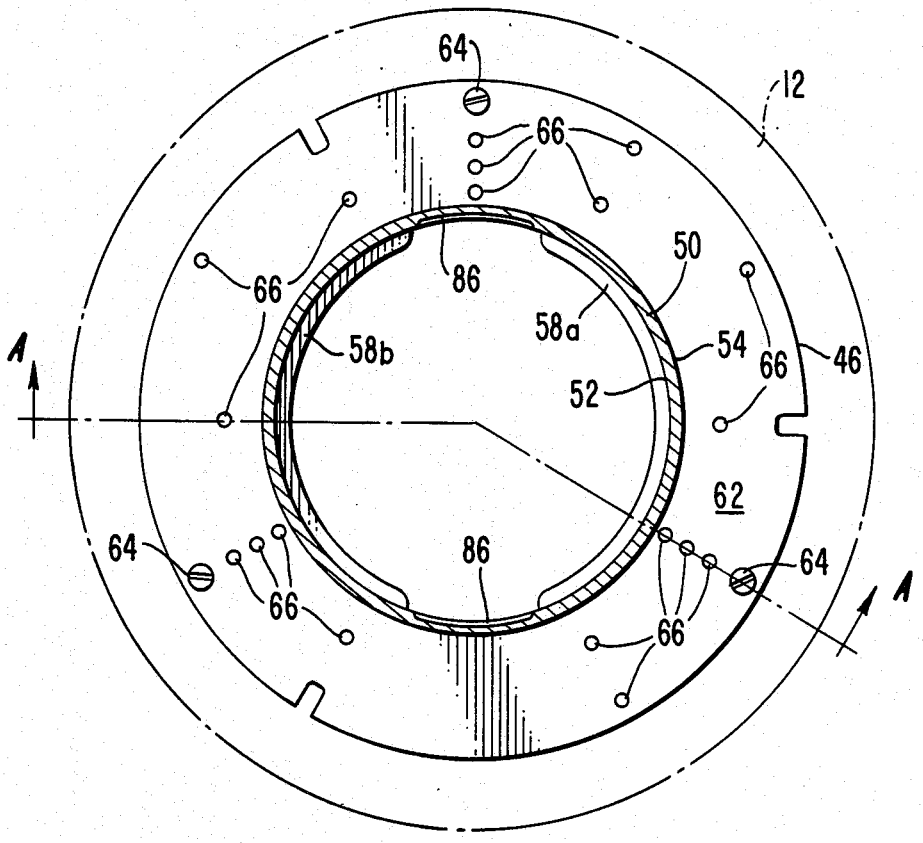
FIG. 3 is an elevational view of a first pad holder member according to the invention, which can be operably connected to the coupling devices shown in FIGS. 2*a* and 2*b*.

A second type of coupling device to which a pad holder according to the present invention can be operably connected is shown in FIG. 2*b*. This coupling device 27 comprises a plate member 29 fixedly attached to a drive shaft 18', the plate member 29 including a plurality of openings 70' providing means for operably connecting a pad holder according to the present invention.

A pad holder according to the present invention is adapted for use with a coupling device, such as coupler 26 shown in FIG. 2*a*. The present invention can be used with any suitable coupling device, the coupling devices 26 and 27 illustrated in FIGS. 2*a* and 2*b* being merely exemplary.

A pad holder according to the present invention includes a first pad holder member 46 and a second pad holder member 48 to be joined in coaxial relationship. See FIGS. 3–6.

The first pad holder member 46 includes a first generally cylindrical member 50 having an inner surface 52 and an outer surface 54. See FIGS. 3 and 4. The outer surface 54 is sized to complementarily mate with and fit within a central aperture 56 of an annular floor cleaning or polishing pad 12, shown in phantom lines in FIGS. 3 and 4.

The inner surface 52 of the first cylindrical member 50 includes a pair of arcuate cam-like ramps 58*a* and 58*b* generally symmetrically disposed opposite each other and circumferentially spaced about the inner surface 52 of the first cylindrical member 50. Ramps 58*a* and 58*b* are positioned for a pad 12 of a predetermined thickness, e.g., one inch. A second pair of arcuate cam-like ramps 60*a* and 60*b* having the same general characteristics as ramps 58*a* and 58*b*, are positioned about the inner surface 52 of the first cylindrical member 50, for pads 12 of a second predetermined thickness, e.g., one-half inch.

A pad holder annular plate member 62 is provided for securing the first pad holder member 46 to a coupling device annular plate member 36. The first pad holder member 46 can be secured to the coupling device annular plate member 36 by any suitable means, such as by screws 64 passing through openings 66, bushings 68 and into openings 70 in coupling device annular plate member 36. The pad holder annular plate member 62 is supported in spaced relationship with coupling device annular plate member 36 by the stop means 42 projecting from coupling device annular plate member 36, and by bushings 68. The pad holder annular plate member 62 supports a top surface 72 of an annular floor cleaning or polishing pad 12.

Annular plate member 62 is provided with a plurality of openings 66 for connection to a variety of coupling devices. Additionally, openings 66 provide padgripping means for pads having gripping projections 74 extending from the upper surface 72 of pad 12. See FIG. 4.

A second pad holder member 48 is provided for joining with the first pad holder member 46 in coaxial relationship. See FIGS. 4, 5 and 6.

The second pad holder member 48 includes a second generally cylindrical member 78 having an outer surface 80 sized to complementarily fit within and mate with the inner surface 52 of the first cylindrical member 50.

Figure 4:
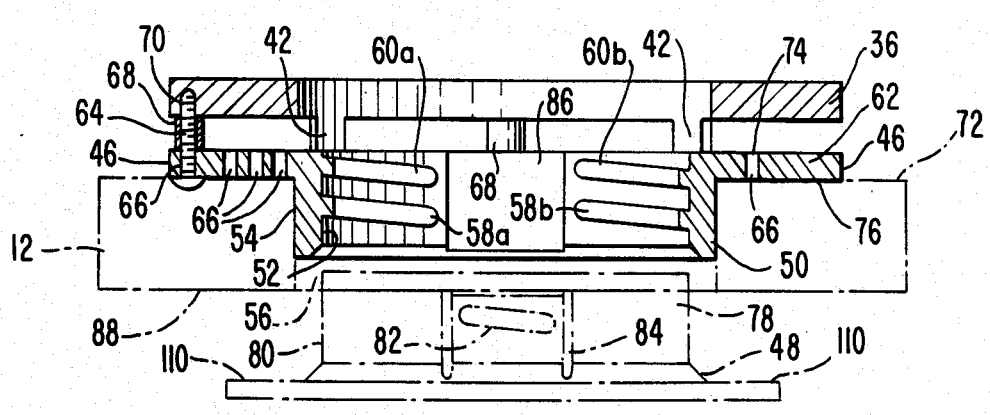
FIG. 4 is a cross-sectional view along line A—A of FIG. 3.
Figure 5:
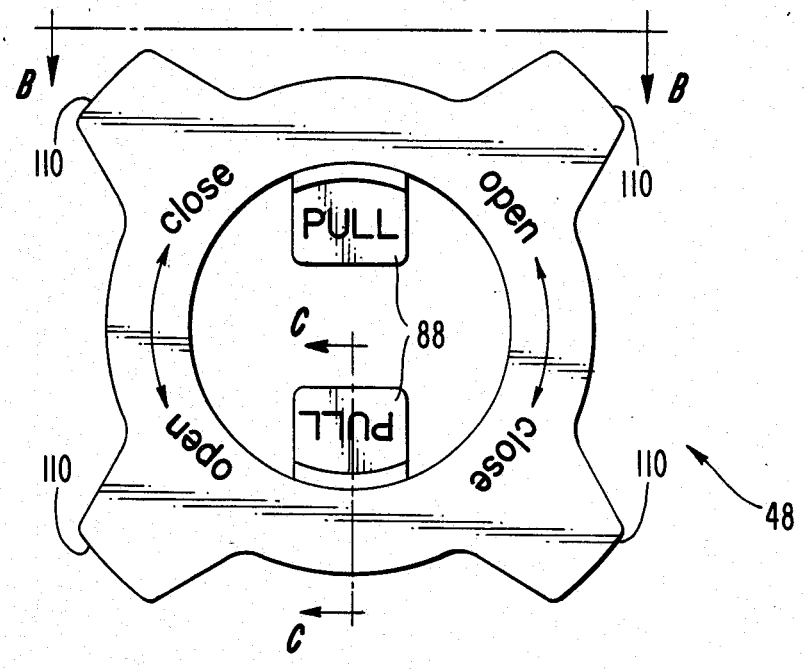
FIG. 5 is an elevational view of a second pad holder member which is interconnectable with the first pad holder member shown in FIG. 3.
Figure 6:
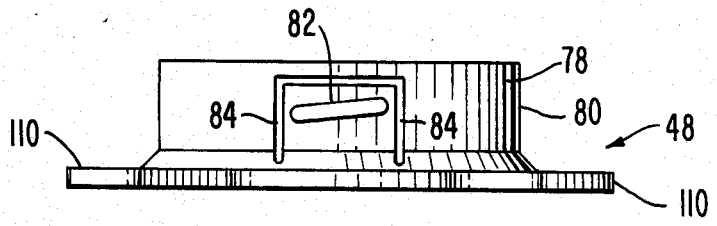
FIG. 6 is a side elevation view along line B—B of FIG. 5.

The second pad holder member 48 includes two lugs 82, one of which is shown in FIGS. 4 and 6. The lugs 82 are adapted to engage the arcuate cam-like ramps 58*a* and 58*b*, or ramps 60*a* and 60*b*, depending on the thickness of pad 12. Lugs 82 engage the cam-like ramps of the first cylindrical member 50 for detachably connecting the second cylindrical member 78 to the first cylindrical member 50 by rotation of the second cylindrical member 78 relative to the first cylindrical member.

The lugs 82 are connected to the second cylindrical member 78 and extend outwardly from the outer surface 80 of the second cylindrical member 78. The lugs 82 are generally symmetrically disposed opposite each other and circumferentially spaced about the outer surface 80 of the second cylindrical member 78.

Lugs 82 fit within guide slots 86 provided in the first cylindrical member 50 for positioning the lugs 82 for engagement with the cam-like ramps 58*a* and 58*b*, or ramps 60*a* and 60*b*.

A plurality of tabs 110 are connected to a bottom portion of the second cylindrical member 78, the tabs extending peripherally outwardly therefrom. The tabs 110 are generally symmetrically disposed opposite each other and circumferentially spaced about the bottom portion of the second cylindrical member 78. The tabs 110 extend over a bottom portion 88 of pad 12 to support and hold a pad 12 against the annular plate member 62. The tabs 110 thereby provide means for rotation of the second cylindrical member 78 relative to the first cylindrical member 50, to engage and disengage the lugs 82 with the cam-like ramps. The tabs 110 also support and hold annular floor cleaning or polishing pads of different thicknesses against the inner surface 76 of the pad holder annular plate 62.

In order to quickly disengage the lugs 82 from the cam-like ramps, means are provided for moving the lugs inwardly and away from a position adjacent the inner surface 52 of the first cylindrical member 50. The pad holder member 48 may thereby be quickly removed from coaxial engagement with pad holder member 46 without rotating flanges 86, to provide for rapid and simple pad replacement.

Figure 7:
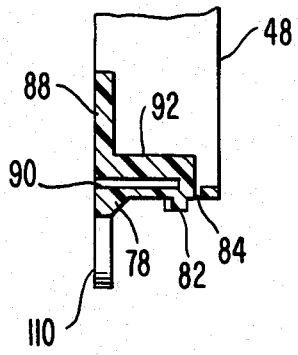
FIG. 7 is a cross-sectional view along line C—C of of FIG. 5 showing one embodiment for quick disconnection of the second pad holder member from the first pad holder member.

In a preferred embodiment, the second pad holder member 48 is constructed in one piece of a relatively stiff and strong, yet resilient and deformable material such as hard rubber or plastic. See FIGS. 5 and 7. According to this embodiment, pull tabs 88 are connected to the inner surface 90 of the second cylindrical member 78 adjacent lugs 82, by means of a connecting post 92. A slot 84 is provided in the second cylindrical member 78 around each lug 82 to permit flexing inward movement of each lug 82. To rapidly disengage the lugs from the cam-like ramps, it is merely necessary to pull tabs 88 thereby flexing that portion of the second cylindrical member 78 defined by slot 84 and moving lugs 82 inwardly and out of engagement with the cam-like ramps. The second pad holder member can then be pulled straight out of coaxial engagement with the first pad holder member, allowing rapid access to the pad for replacement or cleaning.

Although the pad holder of this invention has been described with reference to connection with a coupling device 26 as shown in FIG. 2*a*, it can also be used with any suitable coupling device such as coupler 27 shown in FIG. 2*b*, in which case pad holder 46 can be connected to coupler 27 by means of screws passing through openings 66 and 70'.

The pad holder of the present invention provides for easy changing of floor cleaning or polishing pads of various thicknesses. The center-grip pad holder assures a concentric running machine and also assures that the cleaning or polishing pad does not fall off during operation of the machine.

Since many modifications, variations and changes in detail may be made to the described embodiments, it is intended that all matter in the foregoing description and shown in the accompanying drawings be interpreted as illustrative and not in a limiting sense.

What is claimed is:

1. A pad holder adapted for use with a coupling device, which coupling device operably connects to a rotatable drive shaft of a floor maintenance machine of the type which detachably mounts a rotating floor cleaning or polishing element, said pad holder comprising first and second pad holder members to be joined in coaxial relationship; said first pad holder member including a first generally cylindrical member having inner and outer surfaces, the outer surface of the first cylindrical member being sized to complementarily mate with and fit within a central aperture of an annular floor cleaning or polishing pad, the inner surface of the first cylindrical member including at least two arcuate cam-like ramps generally symmetrically disposed opposite each other and circumferentially spaced about said inner surface of said first cylindical member, said first pad holder member further including means adapted for supporting a top surface of said annular floor cleaning or polishing pad and for securing said first pad holder member to said coupling device for rotation of said pad holder concurrently with said drive shaft; said second pad holder member including a second generally cylindrical member having an outer surface sized to complementarily fit within and mate with the inner surface of the first cylindrical member, the second pad holder member further including at least two lugs adapted to engage said arcuate cam-like ramps of said first cylindrical member for detachably connecting said second cylindrical member to said first cylindrical member by rotation of said second cylindrical member relative to said first cylindrical member, the lugs being connected to said second cylindrical member and extending outwardly from the outer surface of the second cylindrical member, the lugs being generally symmetrically disposed opposite each other and circumferentially spaced about the outer surface of said second cylindrical member, said second pad holder member further including means for disengaging said lugs from said cam-like ramps by moving said lugs inwardly and away from a position adjacent the inner surface of said first cylindrical member, said second pad holder member further including means adapted for rotation of said second cylindrical member relative to said first cylindrical member to engage and disengage said lugs with said ramps and for supporting and holding an annular floor cleaning or polishing pad of a predetermined thickness against the pad top surface-supporting means.

2. The pad holder of claim 1 further including a second set of at least two arcuate cam-like ramps generally symmetrically disposed opposite each other and circumferentially spaced about said inner surface of said first cylindrical member, said second set of cam-like ramps being positioned for holding an annular floor cleaning or polishing pad of a second predetermined thickness.

3. The pad holder of claim 1 wherein said means adapted for supporting a top surface of said annular floor cleaning or polishing pad and for securing said first pad holder member to said coupling device comprises an annular plate member connected to a top portion of said first cylindrical member.

4. The pad holder of claim 3 wherein said annular plate member is adapted for securing gripping projections extending from an upper surface of a floor cleaning or polishing pad to prevent rotation of said pad relative to said pad holder.

5. The pad holder of claim 1 wherein said means adapted for supporting and holding said annular floor cleaning or polishing pad against the pad top surface-supporting means and for rotation of said second cylindrical member relative to said first cylindrical member to engage and disengage said lugs with said ramps comprises at least two tabs connected to said second cylindrical member, the tabs extending peripherally outwardly from a bottom portion of said second cylindrical member, the tabs being generally symmetrically disposed opposite each other and circumferentially spaced about said bottom portion of the second cylindrical member, the tabs being positioned to extend over a bottom portion of said pad to support and hold said pad against said pad top surface-supporting means.

6. The pad holder of claim 5 wherein the pad bottom portion-supporting and holding means further includes a second set of at least two tabs as defined in claim 5 wherein said second set of tabs is generally symmetrically disposed between said tabs defined in claim 5.

7. The pad holder of claim 1 further including guide slots in the inner surface of said first cylindrical member separating said cam-like ramps, the lugs fitting within the guide slots for positioning said lugs for engagement with said ramps.

8. The pad holder of claim 1 wherein the lug-disengaging means includes pull tabs operably connected to the lugs.

9. The pad holder of claim 8 further including slots in the second cylindrical member around each lug to permit flexing motion of the lugs for disengagement with the ramps.

* * * * *